US006726616B2

(12) United States Patent
Militzer et al.

(10) Patent No.: US 6,726,616 B2
(45) Date of Patent: Apr. 27, 2004

(54) TWO-PART CYLINDER FOR A FOLDER IN A ROTARY PRINTING MACHINE

(75) Inventors: Winfried Militzer, Plauen (DE); Karl-Heinz Höhle, Plauen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/061,996

(22) Filed: Feb. 1, 2002

(65) Prior Publication Data

US 2002/0100382 A1 Aug. 1, 2002

(30) Foreign Application Priority Data

Feb. 1, 2001 (DE) ..... 101 04 411

(51) Int. Cl.[7] ..... B65H 45/16

(52) U.S. Cl. ..... 493/424; 493/434; 493/442; 493/476; 492/16

(58) Field of Search ..... 492/16, 40; 493/476, 493/475, 424, 442, 434, 429

(56) References Cited

U.S. PATENT DOCUMENTS 4,273,320 A * 6/1981 Fujishiro ..... 493/427
4,892,036 A 1/1990 Lange ..... 101/240
5,057,064 A * 10/1991 Michalik ..... 493/8
5,201,701 A * 4/1993 Roettger et al. ..... 493/425
5,425,697 A * 6/1995 Lanvin ..... 493/426
5,468,209 A * 11/1995 Rohrhiursch et al. ..... 493/424
5,676,630 A * 10/1997 Mayr ..... 493/424
6,398,701 B1 * 6/2002 Mohrmann ..... 492/39
6,398,704 B1 * 6/2002 Shibuya et al. ..... 493/424

FOREIGN PATENT DOCUMENTS

GB 1122405 8/1968
GB 1194451 6/1970

* cited by examiner

*Primary Examiner*—John Sipos
(74) *Attorney, Agent, or Firm*—Cohen, Pontani, Lieberman & Pavane

(57) ABSTRACT

The cylinder includes first and second cylinder parts which are designed to be rotatable in relation to one another in the circumferential direction and are fitted with respective first and second operating elements for acting on a foldable product. The first cylinder part is mounted non-rotatably on a shaft and of the second cylinder part is mounted on the shaft rotatably in the circumferential direction. The shaft is mounted at one end, fixed axially, in a side wall in a bearing designed as a fixed bearing. The second cylinder part is mounted separately, with a spacing (A) from the first cylinder part, in a second fixed bearing which is independent of the first bearing.

7 Claims, 1 Drawing Sheet

TWO-PART CYLINDER FOR A FOLDER IN A ROTARY PRINTING MACHINE

BACKGROUND OF THE INVENTION

1. Field of the Invention

The invention relates to a cylinder for the folder of a rotary printing machine, the cylinder having first and second cylinder parts which are rotatable relative to each other and are fitted with first and second operating elements for acting on foldable product The first cylinder part is mounted non-rotatably on a shaft having one end mounted for rotation in a fixed bearing in a first sidewall.

2. Description of the Related Art

U.S. Pat. No. 4,892,036 discloses a folding-flap cylinder with two cylinder parts which are fitted in each case with folding flaps and which, for the adjustability of the operation of folding a foldable product effected by the folding flaps, are arranged, rotatably in relation to one another, coaxially to a shaft mounted at one end by means of a fixed bearing and at its other end by means of a loose bearing on a frame. In addition to a mounting of the cylinder parts which ensures rotation, in order to fix one cylinder part axially the latter is supported in the axial direction on the other cylinder part connected firmly to the shaft. The axial fit of the cylinder parts which is necessary for this purpose requires a corresponding outlay in terms of production. On account of the functionally necessary narrow fit tolerances between the cylinder parts, fitting corrosion and dirt may impede the rotation of the cylinder parts in relation to one another.

SUMMARY OF THE INVENTION

The object of the invention is to provide a two part cylinder for folders, which reduces the outlay in terms of production for fixing the cylinder parts axially and which unrestrictedly ensures the rotation of the cylinder parts in relation to one another for its adjustability.

According to the invention, the second cylinder part is mounted for rotation in a second fixed bearing which is independent of the first fixed bearing, end is axially spaced from the first cylinder part.

By the cylinder parts being fixed axially in each case with the aid of a fixed bearing in the frame, axial displaceability can be restricted, at low outlay, to a small tolerance, this having a positive effect on the quality of the folding operation on account of the drive of the cylinder parts which is designed with helical toothing. Fitting work in the axial direction between the cylinder parts spaced from one another in this direction may be dispensed with.

The avoidance of fretting corrosion and jamming as a result of dirt ensures a functionally appropriate adjustment of the cylinder parts in relation to one another.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
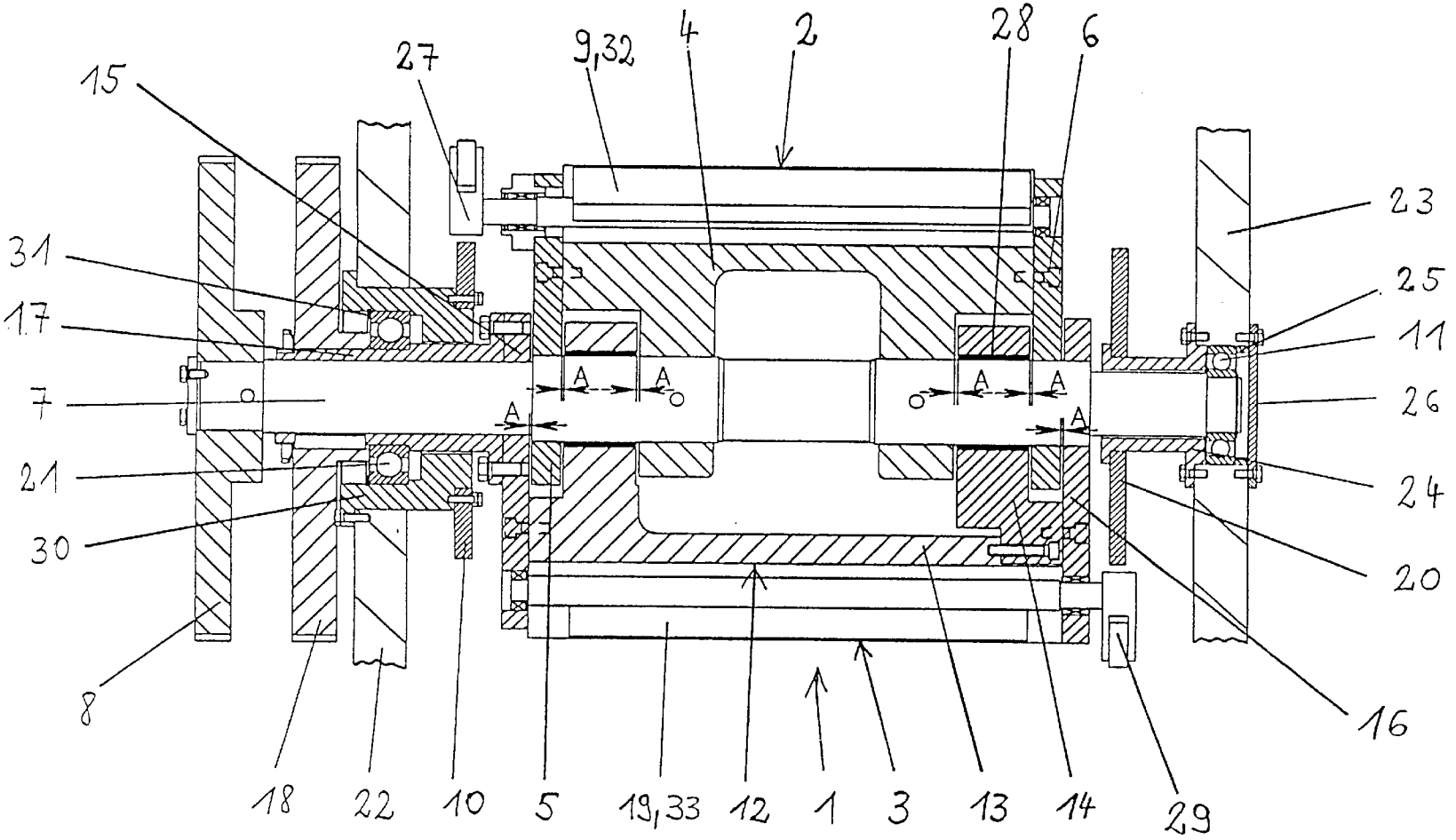
FIG. 1 shows diagrammatically a cylinder in the folder with two folding systems.

FIG. 1 shows a cylinder 1, for example a folding-flap cylinder. The cylinder 1 consists, for example, of two cylinder parts 2; 3 with operating elements 32; 33 arranged on them, here, for example, two folding flaps 9; 19 which are rotatable in relation to one another in the circumferential direction, in order to implement a prefolding adjustment or a changeover of the type of folding, for example from a ¼ fold to a ⅓ fold, and vice versa. By means of the cylinder part I 2, for example, the second transverse fold is made. By means of the cylinder part II 3, for example, the first transverse fold is made.

The cylinder part I 2 consists of a cylinder body I 4, side discs 5; 6, a shaft 7, a driving wheel 8, folding flaps 9, a cam body 10 and a bearing 11.

The cylinder part II 3 consists of a, for example, bisected cylinder body II 12 which is composed of cylinder elements 13; 14. Furthermore, the cylinder part II 3 consists of side discs 15, 16, a sleeve 17, a driving wheel 18, folding flaps 19, a cam body 20 and a bearing 21.

The cylinder body I 4 is firmly mounted on a shaft 7. The cylinder body I 4 is arranged preferably coaxially to the shaft 7.

The shaft 7 is arranged between side walls 22; 23 of a frame, the shaft 7 being mounted rotatably on the side wall 23 by means of the bearing 11. The bearing 11 is fastened axially non-displaceably in the first side wall 23 by means of a sleeve 24, a spacer element 25 and a cover element 26. The bearing 11 is thus designed as a fixed bearing. The cam body 20 is mounted on the sleeve 24. Arranged on the side wall 22 is a sleeve 17, in which the shaft 7 is received and rotatably mounted.

The driving wheel 8 is arranged on the shaft 7 on the end face. Arranged on the cylinder part I 4 are the side discs 5; 6, between which one or more folding flaps 9 are rotatably mounted. A roller lever 27 is arranged on the folding flap 9. The roller lever 27 is illustrated, rotated, in FIG. 1.

Alternatively, this not being illustrated in any more detail, the shaft 7 may also be mounted on the side wall 22 by means of the bearing 11.

The cylinder body II 12 is mounted on the shaft 7 by means of bearings 28 which may be designed as sliding bearings or as rolling bearings. The cylinder body II 12 is arranged preferably coaxially to the shaft 7. The cylinder body II 12 is thus mounted on the shaft 7 rotatably in relation to the cylinder body II 4. Arranged on the cylinder body II 12, in particular on the cylinder elements 13; 14, are the side discs 15; 16, between which one or more folding flaps 19 are rotatably mounted. A roller lever 29 is arranged on the folding flap 19. The roller lever 29 is illustrated, rotated, in FIG. 1. The side disc 15 is connected fixedly in terms of rotation to the sleeve 17. Fastened to the side wall 22 is a bearing bush 30, on which the cam body 10 is mounted. The bearing 21 and the driving wheel 18 are arranged on the sleeve 17. The bearing bush 30, a fastening element 31, for example a securing ring, the driving wheel and the sleeve 17 prevent the bearing 21 form sliding axially. The bearing 21 is thus fastened axially non-displaceably.

The bearing 21 is thus designed as a fixed bearing.

The cylinder 1, in particular the cylinder body I 4 mounted firmly on the shaft 7, can be driven in rotation via a drive device, not illustrated in any more detail, which is arranged on the driving wheel 8. A further or the above-mentioned drive device, not illustrated in any more detail, is connected to the driving wheel 18, as a result of which the rotational drive of the cylinder body II 12 and adjustment in the circumferential direction of the cylinder body II 12 in relation to the cylinder body I 4 are implemented.

In structural terms, displaceability by an amount A is provided as a result of the two cylinder bodies 4; 12 being spaced axially from one another, the amount A corresponding to the spacing of the two cylinder bodies 4; 12 which ensures the functioning of the loose bearings for the two cylinder bodies 4; 12.

The cylinder parts I 2 and II 3 or the cylinder bodies I 4 and II 12 are fixed axially by means of the respective bearings 11; 21 in the side walls 22; 23.

What is thereby achieved, at the same time, is that the cylinder parts and/or cylinder bodies do not come into contact with one another, and, as a result, from the outset, there is no risk of "seizure" or jamming due to rust or other corrosive damage at the fittings, dirt or the like.

Suitable rolling bearings, for example angular-contact ball bearings, are to be used for the bearings 11; 21, and, as a result, the axial play of the cylinder 1 can be kept very low without any appreciable outlay in manufacturing terms. Since the axial play of the cylinder 1 is very low, increased folding and cutting accuracy is thereby achieved. This is desirable, for example, particularly in the construction of illustration printing machines.

The device according to the invention is not to be restricted only to use with regard to multi-part folding cylinders. It is also conceivable, for example, this not being illustrated in any more detail, to use it in the case of multi-part folding-knife cylinders, multi-part cutting cylinders or multi-part transverse-perforation cylinders in folders.

In this case, when the cylinder 1 is used as a folding-knife cylinder, the operating elements 32; 33 of the cylinder parts 2; 3 are designed as folding knives or a holding element for the foldable product.

When the cylinder 1 is used as a cutting cylinder, the operating elements 32; 33 of the cylinder parts 2; 3 are designed as cutting knives.

When the cylinder 1 is used as a transverse-perforation cylinder, the operating elements 32; 33 of the cylinder parts 2; 3 are designed as perforating knives.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A cylinder for folders of a rotary printing machine, said cylinder comprising an axially fixed shaft having one end mounted for rotation in a first fixed bearing in a first sidewall, a first cylinder part mounted on said shaft and being fitted with a first operating element for acting on a foldable product, said first cylinder part being fixed against rotation relative to said shaft, and a second cylinder part mounted for rotation with respect to said shaft in a second fixed bearing which is independent of said first fixed bearing, said second cylinder part being fitted with a second operating element for acting on a foldable product, said second cylinder part being axially spaced from said first cylinder part and being rotatable relative to said first cylinder part;

wherein said shaft has another end which is supported rotatably in a sleeve which is fixed to said second cylinder part, said sleeve being fixed axially and being mounted for rotation in said second fixed bearing in a second sidewall.

2. A cylinder as in claim 1 wherein said first and second cylinder parts are fixed axially relative to said first and second sidewalls by means of said first and second bearings, said second cylinder part fitted to said shaft by means of a slide mounting which permits relative rotation of said cylinder parts.

3. A cylinder as in claim 1 wherein said first and second cylinder parts are fixed axially, said first and second bearings permitting relative rotation of said first and second cylinder parts.

4. A cylinder as in claim 1 wherein said cylinder is designed as a folding-flap cylinder, said first and second operating elements being folding flaps.

5. A cylinder as in claim 1 wherein said cylinder is designed as a folding-knife cylinder, said first and second operating elements being one of folding knives and holding elements for the foldable product.

6. A cylinder as in claim 1 said cylinder is designed as a cutting cylinder, said first and second operating elements being cutting knives.

7. A cylinder as in claim 1 wherein said cylinder is designed as a transverse perforation cylinder, said first and second operating elements being perforating knives.

* * * * *